US008225740B2

(12) United States Patent
Mitsui et al.

(10) Patent No.: US 8,225,740 B2
(45) Date of Patent: Jul. 24, 2012

(54) PAINT ROBOT AND PAINT CARTRIDGE

(75) Inventors: Michio Mitsui, Yokohama (JP); Ryuji Tani, Yokohama (JP); Sadao Inose, Yokohama (JP)

(73) Assignee: Ransburg Industrial Finishing K.K., Yokohama-Shi, Kanagawa (JP)

( * ) Notice: Subject to any disclaimer, the term of this patent is extended or adjusted under 35 U.S.C. 154(b) by 202 days.

(21) Appl. No.: 12/745,470

(22) PCT Filed: Nov. 4, 2008

(86) PCT No.: PCT/JP2008/070025

§ 371 (c)(1),
(2), (4) Date: Jul. 21, 2010

(87) PCT Pub. No.: WO2009/069435

PCT Pub. Date: Jun. 4, 2009

(65) Prior Publication Data

US 2010/0307413 A1 Dec. 9, 2010

(30) Foreign Application Priority Data

Nov. 29, 2007 (JP) ..... 2007-308434

(51) Int. Cl.

| | |
|---|---|
| ***B05B 3/00*** | (2006.01) |
| ***B05B 3/04*** | (2006.01) |
| ***B05B 5/025*** | (2006.01) |
| ***B67D 7/00*** | (2010.01) |

(52) U.S. Cl. ..... 118/323; 118/629; 239/690; 239/583; 141/67; 141/20.5; 141/27; 901/43; 222/165; 222/325; 222/326

(58) Field of Classification Search ..... 118/323, 118/321, 620–640; 141/27, 20.5, 94, 67, 141/104, 302; 239/690, 690.1, 700, 583; 222/165, 325–327; 427/458; 901/43
See application file for complete search history.

(56) References Cited

U.S. PATENT DOCUMENTS

| | | | | |
|---|---|---|---|---|
| 5,503,335 | A | 4/1996 | Noakes et al. | |
| 6,164,561 | A | 12/2000 | Yoshida et al. | |
| 6,284,047 | B1 * | 9/2001 | Yoshida et al. | 118/629 |
| 6,612,345 | B1 | 9/2003 | Hosoda et al. | |

(Continued)

FOREIGN PATENT DOCUMENTS

| | | |
|---|---|---|
| CN | 1048661 | 1/2000 |

(Continued)

OTHER PUBLICATIONS

ISR for PCT/JP2008/070025 dated Dec. 9, 2008.

*Primary Examiner* — Yewebdar Tadesse
(74) *Attorney, Agent, or Firm* — Lowe Hauptman Ham & Berner LLP

(57) ABSTRACT

An arm of a coating robot is used to prevent external leakage of a high voltage. A tank is installed on a robotic arm and contains water as an actuating liquid. The water is supplied to a paint cartridge by a pump controlled by a controller. The water sent from the pump under pressure is supplied to the paint cartridge by a conduit tube. A high voltage generator and a bleeder resistor are combined with the tank such that a high voltage generated by the high voltage generator is supplied to the electrostatic paint applicator via the water. For replenishment of water to the tank is attained by relatively connecting a nozzle in communication with a water source to a main pipe. While the high voltage generator generates a high voltage, the nozzle and the main pipe are kept disconnected to maintain electrical insulation between the nozzle and the main pipe.

11 Claims, 6 Drawing Sheets

U.S. PATENT DOCUMENTS

| | | | | |
|---|---|---|---|---|
| 7,399,363 | B2 * | 7/2008 | Clifford et al. | 118/323 |
| 2005/0189435 | A1 * | 9/2005 | Kubota et al. | 239/223 |
| 2007/0082143 | A1 * | 4/2007 | Baumann et al. | 427/458 |

FOREIGN PATENT DOCUMENTS

| | | | |
|---|---|---|---|
| JP | 9329085 | A | 12/1997 |
| JP | 2000317360 | A | 11/2000 |
| JP | 2005087810 | A | 4/2005 |
| JP | 2005296750 | A | 10/2005 |
| JP | 2006341192 | A | 12/2006 |
| JP | 2006347606 | A | 12/2006 |

* cited by examiner

PAINT ROBOT AND PAINT CARTRIDGE

RELATED APPLICATIONS

The present application is national phase of PCT/JP2008/070025 filed Nov. 4, 2008, and claims priority from Japanese Application Number 2007-308434 filed Nov. 29, 2007, the disclosures of which are hereby incorporated by reference herein in their entirety.

FIELD OF THE INVENTION

The present invention relates to a coating robot and a paint cartridge.

BACKGROUND OF THE INVENTION

Cartridge-type electrostatic paint applicators are known as being suitable for use with electrically conductive paints such as water-borne paints and metallic paints. Patent documents 1 to 3 disclose cartridge-type electrostatic paint applicators. These cartridge-type electrostatic paint applicators make it easy to prevent high-voltage leak, which is the phenomenon that a high voltage applied to an electrostatic applicator externally leaks through an electrically conductive paint.

A typical cartridge-type electrostatic applicator has a paint cartridge detachably attached to a rear end of the main body of the electrostatic paint applicator. The paint cartridge contains an electrically conductive paint. When the paint in the paint cartridge is exhausted, the cartridge is replaced by a new paint cartridge containing a predetermined quantity of paint.

Patent Document 1 proposes the use of a paint bag containing a paint and an actuating bag receiving an actuating liquid, both accommodated in a paint cartridge case, such that the actuating bag swells out when it is supplied with the actuating liquid through a conduit extending in a robotic arm. The actuating bag thereby pushes the paint bag to extrude the paint out of the paint bag. The outflow quantity of the paint from the paint bag can be controlled by adjusting the quantity of the actuating liquid supplied to the actuating bag.

Similarly to Patent Document 1, Patent Document 2 proposes the use of a paint bag and an actuating bag accommodated in a paint cartridge case, such that the actuating bag squeezes the paint bag when swelling out with an actuating liquid supplied through a conduit extending in a robotic arm. This Patent Document 2 also proposes partly binding contact surfaces of the paint bag and the actuating bag with each another to prevent positional deviation between contact surfaces of the paint bag and the actuating bag.

Patent Document 3 proposes to accommodate a paint bag in a case of a paint cartridge and squeezing the paint bag by supplying an actuating liquid into the space inside the case through a conduit extending in a robotic arm. This patent document also proposes to make the case of a transparent material such that any trouble in the case can be found easily.

The paint cartridges disclosed by the Patent Documents 1 to 3 have both a paint port for passage of the paint and an actuating liquid port for passage of the actuating liquid at the bottom of the case.

The aforementioned cartridge-type electrostatic paint applicators are actually used for coating vehicle bodies. It is known that coating robots are conveniently used for electrostatic coating of vehicles.

Patent Document 4 proposes a system for exchanging a paint cartridge. This cartridge exchanging system comprises a stock mechanism for stocking an empty paint cartridge, a paint refill mechanism for refilling the empty paint cartridge, and a cartridge exchanging mechanism for transporting the paint cartridge to and from the coating robot. The cartridge exchanging mechanism includes a handling means for clutching the paint cartridge. The handling means is movable vertically and horizontally.

The handling means picks up an empty paint cartridge heretofore stocked in the stock mechanism, then transports it to a paint refill position, and puts down the paint cartridge at the paint refill position. Simultaneously, the refill mechanism moves up, and couples with the paint port at the bottom of the paint cartridge. The paint refill mechanism refills the paint cartridge (paint bag) with a predetermined amount of paint through the paint port. After the refill of the paint, the paint refill mechanism withdraws downward. The electrostatic paint applicator attached to the coating robot is brought at a predetermined exchange position by a movement of the coating robot. Then, the handling means rotates horizontally to transport the paint cartridge, now refilled with the paint, to the exchange position, and next moves down to connect the paint port and the actuating liquid port at the bottom of the paint cartridge to corresponding ports of the electrostatic paint applicator.

Patent Document 1: JP 2005-87810 A
Patent Document 2: JP 2005-296750 A
Patent Document 3: JP 2006-347606 A
Patent Document 4: JP 2006-341192 A

SUMMARY OF THE INVENTION

The electrostatic paint applicators disclosed by Patent Documents 1-3 control the outflow amount of paint from the paint cartridge by controlling the quantity of the actuating liquid supplied from the paint cartridge. Since the actuating liquid is supplied to the paint cartridge through the coating robot, here is the possibility that the high voltage applied to the electrostatic paint applicator externally leaks through the actuating liquid. To cope with this problem, Patent Documents 1 and 2 use an insulating liquid such as butyl acetate or a thinner as the actuating liquid. Patent Document 3 teaches that water or an organic solvent may be used as the actuating liquid, but also points out that an actuating liquid with a high electric resistance value should preferably be used.

In a coating robot having a cartridge-type electrostatic paint applicator as disclosed in Patent Documents 1 to 3, in which a paint is supplied to the applicator from a paint cartridge by supplying an actuating liquid to the paint cartridge through a conduit in a robotic arm and thereby squeezing the paint bag in the paint cartridge either directly or indirectly, it may occur that a high voltage applied to the applicator leaks externally through the actuating liquid. Therefore, an actuating liquid excellent in electrical insulation must carefully be selected. Further, even though an actuating liquid excellent in electrical insulation, there remain the problem that the insulation performance of the actuating liquid degrades as it is contaminated. Actual coating robots practicing the inventions disclosed in the Patent Documents 1 to 3 use liquids excellent in insulation performance as their actuating liquids.

It is therefore an object of the present invention to provide a coating robot having assembled a cartridge-type electrostatic paint applicator, which is configured to supply the applicator with paint from a paint cartridge by squeezing the paint bag in a paint cartridge either directly or indirectly with an actuating liquid introduced into the paint cartridge through a conduit extending in a robot arm and improved to reliably prevent that a high voltage applied to the applicator externally leaks through the actuating liquid.

It is a further object of the present invention to provide a coating robot capable of cleaning the electrostatic paint applicator by using the actuating liquid.

According to the invention, there is provided a coating robot including an electrostatic paint applicator attached to a robotic arm thereof and configured to supply the electrostatic paint applicator with paint from a paint bag accommodated in a paint cartridge detachably attached to a rear end of the electrostatic paint applicator by squeezing the paint bag in the paint cartridge with a controlled amount of actuating liquid supplied into the paint cartridge, comprising:

a tank fixed on the robotic arm and containing the actuating liquid;

an actuating liquid supply path for supplying the actuating liquid from the tank to the paint cartridge; and a pump interposed in the actuating liquid supply path to supply the actuating liquid from the tank to the paint cartridge under pressure.

With the above-mentioned features, the invention makes it possible to supply the electrostatic paint applicator with a paint in the paint cartridge by supplying the actuating liquid into the paint cartridge from the tank boarded on the robotic arm. In addition, since the tank containing the actuating liquid is boarded on the robotic arm, it is possible to reliably prevent that the high voltage applied to the electrostatic paint applicator leaks out through the actuating liquid simply by insulating the tank from the actuating liquid source throughout the period of coating operation in which the high voltage is applied to the applicator.

In a preferred embodiment of the present invention, an actuation-purpose passageway for supplying the actuating liquid from the tank to the paint cartridge and a cleaning-purpose passageway for cleaning the applicator by using the actuating liquid from the tank are provided at the bottom of the paint cartridge. Then, the actuating-purpose passageway and the cleaning-purpose passageway are selectively set in communication with the tank by controlling their valves.

When a paint color is to be changed to another, the electrostatic paint applicator can be cleaned with the actuating liquid in the tank by setting the cleaning-purpose passageway at the bottom of the paint cartridge in communication with the tank. The other objects and advantages of the present invention will become apparent from the description of embodiments of the invention, which will follow.

LIST OF REFERENCE NUMERALS

Figure 1:
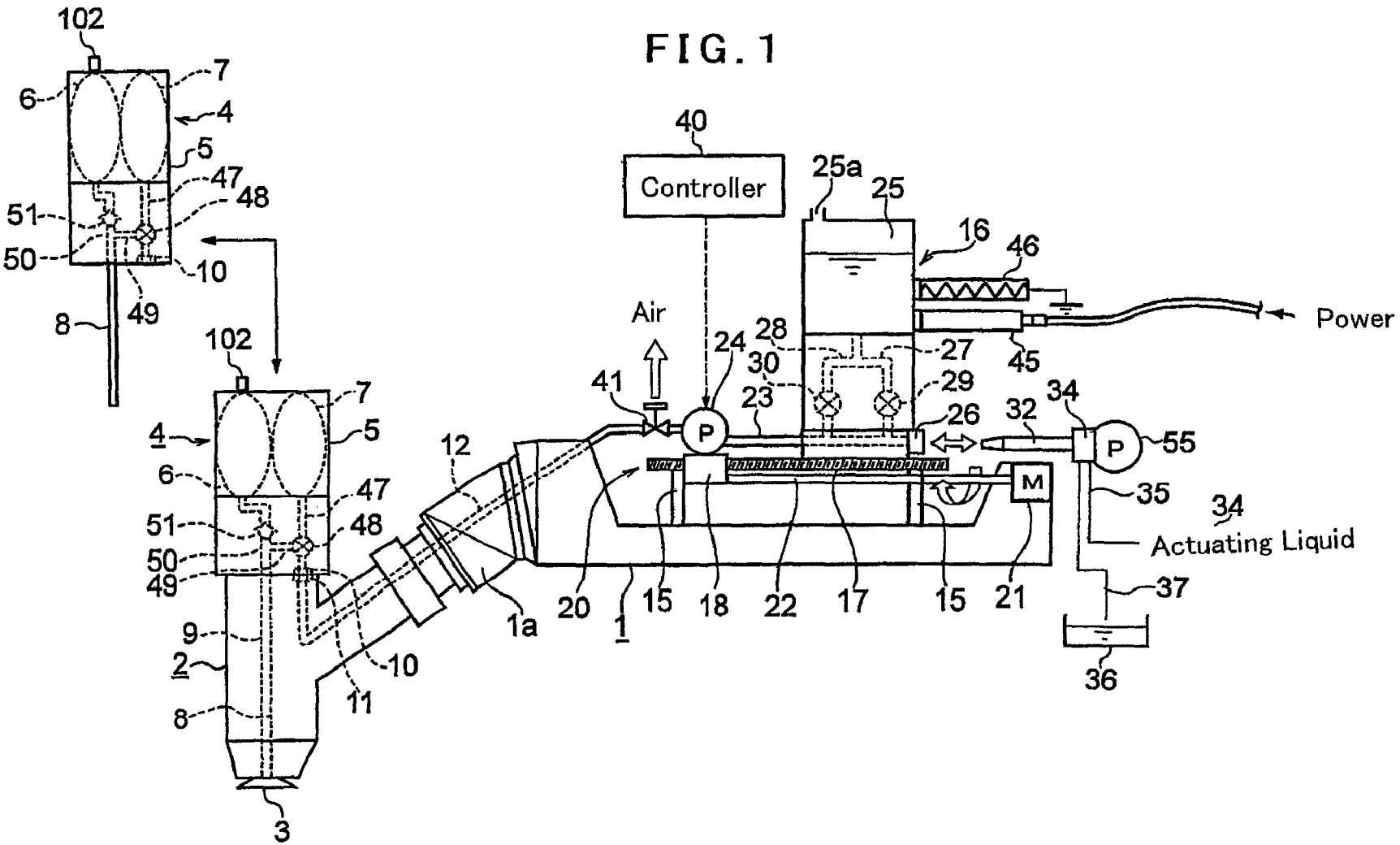
FIG. 1 is a diagram for explaining an outline of a robotic arm of a coating robot and an electrostatic paint applicator attached the robotic arm according to the first embodiment of the present invention.

1 Arm of a painting robot
2 Electrostatic paint applicator
4 Paint cartridge
6 Paint bag
7 Actuating bag
8 Paint feed tube
9 Port for receiving the paint feed tube (in the applicator)
12 Conduit tube (actuating liquid supply tube)
15 Table
16 Mobil unit
17 Fully threaded rod
18 Gear box
21 Motor
23 Main pipe
24 Pump
25 Tank
26 Connection port with a check valve
32 Nozzle
34 Liquid source
40 Controller
45 High voltage generator (cascade)
46 Bleeder resistor
102 Paint refill port (paint cartridge)

MODE FOR CARRYING OUT THE INVENTION

Some preferred embodiments of the present invention will now be described below with reference to the drawings.

Figure 2:
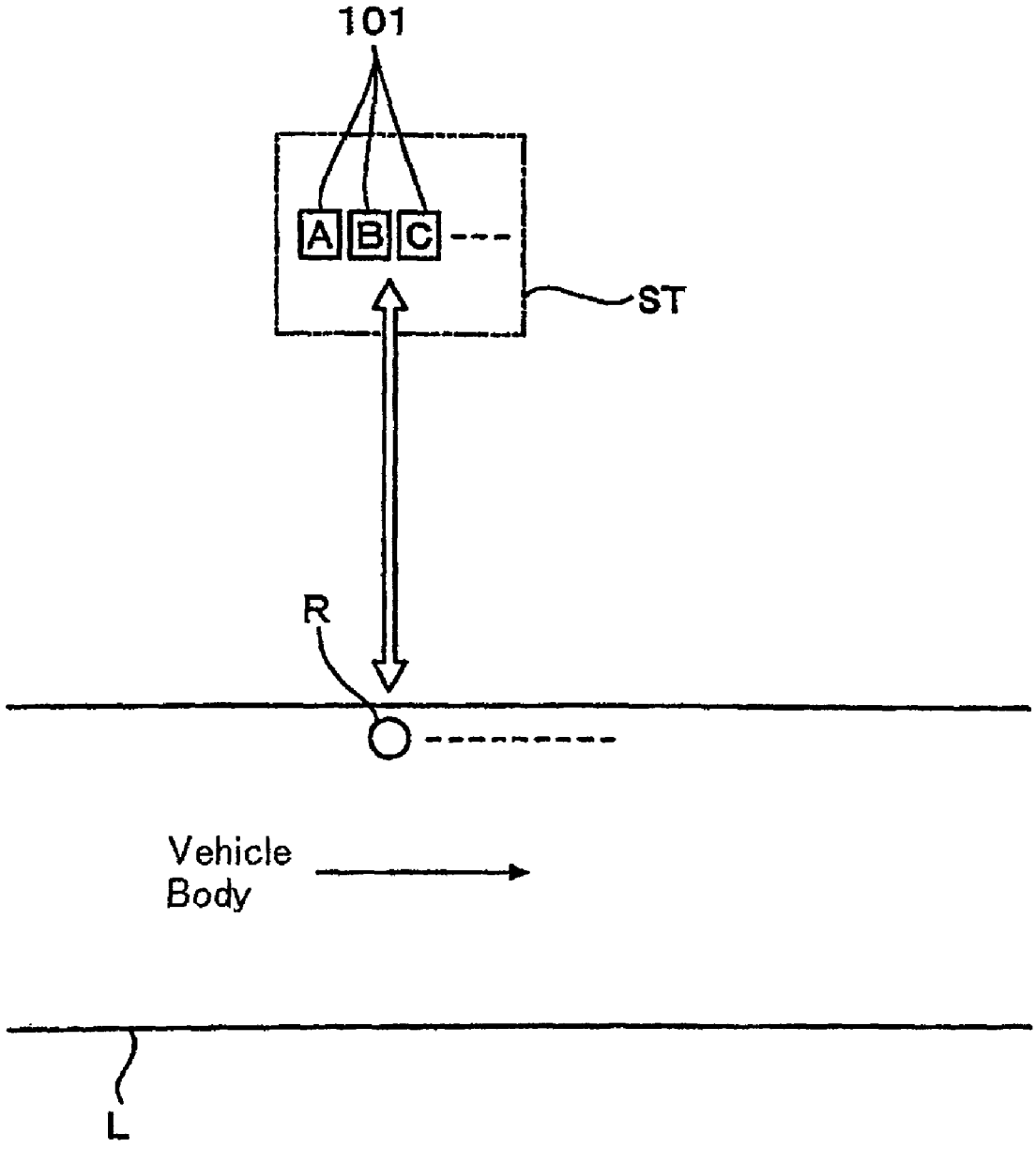
FIG. 2 is a diagram for explaining a relationship between a vehicle body coating line and a paint refill station in relation to the coating robot.

FIG. 1 shows a general aspect of a coating robot R according to the first embodiment of the invention usable with a water-borne paint as a typical one of electrically conductive paints. In FIG. 1, reference numeral 1 denotes a robotic arm. As shown in FIG. 2, the painting robot R is set on a coating line L for electrostatic coating of vehicles. A paint refill station ST is provided in an area adjacent to the coating line L, to which the painting robot R can move. In the paint refill station ST, support seats 101 for color A, color B, color C, et seq., which will be explained later, are provided in a region where the robotic arm 1 of the coating robot R reaches.

As being well known, the coating robot R includes a robotic arm at an upper end of a column standing on a pedestal and capable of swinging and pivotal movements. An electrostatic paint applicator 2 is removably attached to a polyarticular wrist portion 1*a* at a distal end of the robotic arm 1. The electrostatic paint applicator 2 may be of a rotary atomization type having a rotary atomizing head (so called "bell cup) or of a spray type.

At a read end of the electrostatic paint applicator 2, a paint cartridge 4 can be attached removably. Once the paint cartridge 4 is attached to the applicator 2, the paint cartridge 4 is fixed to the applicator 2 by a lock means, not shown. The paint cartridge 4 may be substantially the same as those disclosed in the Patent Documents 1 to 3 discussed above. Therefore, in regard to detailed configurations of the electrostatic paint applicator 2 related to the paint cartridge 4, contents of the Patent Documents 1 to 3 are herein incorporated by reference.

The paint cartridge 4 accommodates, in a case 5, a paint bag 6 and an actuating bag 7. Regarding the paint bag 6 and the actuating bag 7, FIG. 1 only shows their existence. The paint bag 6 and the actuating bag 7 are held in the case 5 without a gap between the both bags and between the bags and the case. By accommodating the paint and the actuating liquid in the paint bag 6 and the actuating bag 7, respectively, the paint and the actuating liquid are prevented from leaking externally from the paint cartridge 4 even upon movements of the robotic arm 1. Water as an actuating liquid may be filled between the paint bag 6 and the actuating bag 7 as well. The actuating bag 6 is not indispensable, and may be omitted like that in the paint cartridge disclosed by the Patent Document 3. Therefore, the space that receives the actuating liquid supplied to the case 5 is hereafter called an "actuating liquid space". When the actuating bag 7 is used, the actuating liquid space is the inner space of the actuating bag 7. When the actuating bag is omitted, the actuating liquid space is the space around the paint bag 6 in the case 5. The embodiment explained below uses the actuating bag 7.

The paint cartridge 4 preferably has a paint feed tube 8 in communication with the paint bag 6 at its lower end. It is also possible to provide a paint outlet port 50 at the lower end of the paint cartridge 4 to communicate with the paint bag 6 (FIG. 3) and provide a port at the rear end of the electrostatic paint applicator 2 to get into watertight communication with the paint outlet port 50. Reference numeral 51 appearing in FIGS. 1 and 3 denotes a check valve that permits the paint to flow out from the paint bag 6 but prevents its opposite flow. Details of this modification are disclosed in the Patent Documents 1 and 3. Therefore, related disclosures of the Patent Documents 1-3 are incorporated herein by reference.

The paint feed tube 8 enters into the electrostatic paint applicator 2 when the paint cartridge 4 is boarded on the applicator 2. The paint in the paint bag 6 is supplied through the paint feed tube 8 to a central portion of the bell cup 3. That is, the electrostatic paint applicator 2 has a port 9 opening at its rear end surface. The paint feed tube 8 is received in the port 9. The bell cup 3 is rotated by an air motor like in existing applicators.

In this embodiment, water that is an electrically conductive liquid is used as the actuating liquid as explained above. To supply the actuating bag 7 with the water as the actuating liquid, the paint cartridge 4 has a water inlet port 10 at its lower end to communicate with the actuating bag 7. The water inlet port 10 is watertightly coupled to a water supply port 11 at the rear end of the electrostatic paint applicator 2 when the paint cartridge 4 is boarded on the applicator 2. In this respect, the Patent Documents 1-3 describe in detail. Therefore, related contents of the Patent Document 1-3 are incorporated herein by reference instead of describing here.

In the electrostatic paint applicator 2 and the robotic arm 1, a conduit tube (actuating liquid supply tube) 12 extends in communication with the water supply port 11. The conduit tube 12 is made of an electrically insulating material.

A table 15 made of an electrically insulating material is set stationary in the robotic arm 1, and a movable unit 16 is put on the insulating table 15. The movable unit 16 is driven by a drive mechanism 20 comprising a fully threaded rod 17 and a gear box 18 to move in the right-and-left direction in FIG. 1 on the top surface of the table 15.

A rotating force of a rotary shaft 22 made of an electrically insulating material and connected to a motor 21 is input into the gear box 18. The fully threaded rod 17 is connected to an output shaft (not shown) of the gear box 18. Rotation of the motor 21 is converted to a linear movement by a nut (not shown) in meshing engagement with the threaded rod 17. More specifically, the nut is embedded in the movable unit 16, and the threaded rod 17 rotated by rotational movement of the motor 21 guides the nut to move the entirety of the movable unit 16 in the right-and-left direction in FIG. 1 on the top surface of the table 15.

A main pipe 23 made of an electrically insulating synthetic resin material is provided at a lower end portion of the movable unit 16. One end of the main pipe 23 is connected to the conduit tube 12 via a pump 24. The main pipe 23 has a connection port 26 with a check valve, explained later, at its opposite end.

A tank 25 containing water as the actuating liquid is supported on the top of the movable unit 16 (FIG. 1). Reference numeral 25*a* denotes a vent hole. The tank 25 is made of an insulating synthetic resin material excluding a part thereof explained later. The tank 25 includes two pipes, i.e. a first pipe 27 and a second pipe 28, which are connected to the main pipe 23 via a first valve 29 and a second valve 30, respectively. Like the main pipe 23, the first and second pipes 27, 28 are made of an electrically insulating synthetic resin material.

In confrontation with the connection port 26 having the chuck valve at the right end of the main pipe 23 in FIG. 1, a nozzle 32 is provided to lie stationary in a horizontal direction. The nozzle 32 is equipped in an actuating liquid replenish station. After the robotic arm 1 is moved to near the nozzle 32, the motor 21 is activated to move the connection port 26 toward the read end of the robotic arm 1. Thereby the connection port 26 and the nozzle 32 are coupled together such that the tank 25 can be replenished with water as the actuating liquid from the actuating liquid source 34. For this purpose, a first pipe 35 in communication with the water source 34 as the actuating liquid source and a second pipe 37 in communication with a drain tank 36 are connected to the nozzle 32 via a valve 33.

The above-explained configuration may be modified to move the nozzle 32 provided in the actuating liquid replenish station toward and away from the connection port 26 that is instead configured to sit stationary in the robotic arm 1. Further, since the connection port 26 and the nozzle 32 are complementary elements with each other, it is possible to provide the connection port 26 as an element on the part of the actuating liquid replenish station and the nozzle 32 as an element on the part of the robotic arm 1. In either configuration of the nozzle 32 and the connection port 26, it is sufficient that one of the connection port 26 and the nozzle 32 is movable. However, both of them may be designed movable as well.

Water (actuating liquid) in the tank 25 is supplied to the main pipe 23 by opening the valve 30 in the second pipe 28 of the movable unit 6. Quantity of water supplied to the conduit tube 12 is controlled by the pump 24 that operates under a command from a controller 40. The conduit tube 12 has a valve 41 at its upstream end portion, and air can be bled from the conduit tube 12 by the valve 41.

The water spouted from the pump 24 under a pressure is supplied to the actuating bag 7 in the paint cartridge 4 through the conduit tube 12. With the supply of water, the actuating bag 7 swells out, and the paint in the paint bag 6 is supplied to the bell cup 3 through the paint feed tube 8. The paint supplied to the bell cup 3 is atomized by revolution of the bell cup 3.

In the tank 25 electrically isolated from the robotic arm by the insulating table 15, a high voltage generator (cascade) 45 and a bleed resistor 46 are provided in an electrical conduction with the water in the tank 25. In this embodiment, the tank 25 is made of an insulating resin except a part thereof as already explained. That is, the tank 25 includes a portion made of, for example, stainless steel, in its sidewall. The high voltage generator 45 and the bleeder resistor 46 are provided adjacent to that portion of the tank 25 made of stainless steel.

A high voltage generated by the high voltage generator 45 is applied to the electrostatic paint applicator 2 by the water from the tank 25, via the first and second pipes 27, 28, main pipe 23 and the conduit tube 12. The high voltage supplied to the electrostatic paint applicator 2 through the water in the conduit tube 12 is next applied to the bell cup 3A via a high voltage supply path that may be arranged as desired. Alternatively, the high voltage may applied to the bell cup 3 via the electrically conductive paint supplied from the paint bag 6 of the paint cartridge 4 to the bell cup 3. As known, the high voltage applied to the bell cup 3 generates an electrostatic field between a work (not shown) and the bell cup 3.

In electrostatic coating operation, the movable unit 16 (main pipe 23) is apart from the nozzle 32. This distance is determined to assure electrical insulation between them. In this condition, the high voltage supply path using the water in the tank 25, first and second pipes 27, 28, main pipe 23 and conduit tube 12 as the conductive material is electrically shut off from outside.

The system may be designed capable of washing the electrostatic paint applicator 2 with the water in the tank 25. In a recommendable arrangement for this purpose, an actuating-purpose passageway 47 is provided at a lower end portion of the paint cartridge 4 for making connection between the water inlet port 10 and the actuating bag 7 to thereby supply the actuating bag 7 with water from the tank 25. Further, a cleaning-purpose passageway 49 is provided in connection with the actuating-purpose passageway 47 via a valve 48 interposed in the actuating-purpose passageway 47. Thus, the cleaning-purpose passageway 49 is connected to a paint path 50 in communication with the paint bag 6 and the paint feed tube 8. The check valve 51 permits the conductive paint to flow from the paint bag 6 toward the paint feed tube 8 but prohibits the reversal flow.

Once the valve 48 is switched and the water supplied from the tank 25 is permitted to flow to the paint path 50 through the cleaning-purpose passageway 49, and then flows through the paint feed tube 8 to the bell cup 3, while cleaning the inside of the paint feed tube 8 and the bell cup 3. That is, the water in the tank 25 is used not only as an actuating liquid for controlling the quantity of paint from the paint cartridge 4 to the bell cup 3 but also as a cleaning liquid for cleaning the electrostatic paint applicator 2.

If the tank 25 does not contain a sufficient amount of water when the pump 24 is off and the conduit tube 12 is not currently supplied with water, i.e. in the state where electrostatic coating by the applicator 2 is interrupted or cleaning of the applicator has been finished, water is replenished to the tank 25 from the water source 34 while power supply to the high voltage generator 45 is interrupted.

Upon cleaning the electrostatic paint applicator 2 following to changing the paint color, power supply to the high voltage generator 45 is stopped, and generation of a high voltage is interrupted as well. Any residual electric charge in the applicator 2 is discharged via the water in the water line of the applicator 2 and the robotic arm 1 (conduit tube 12, main pipe 23, first and second pipes 27, 28) via the bleeder resistor 46 connected to the ground potential.

Figure 4:
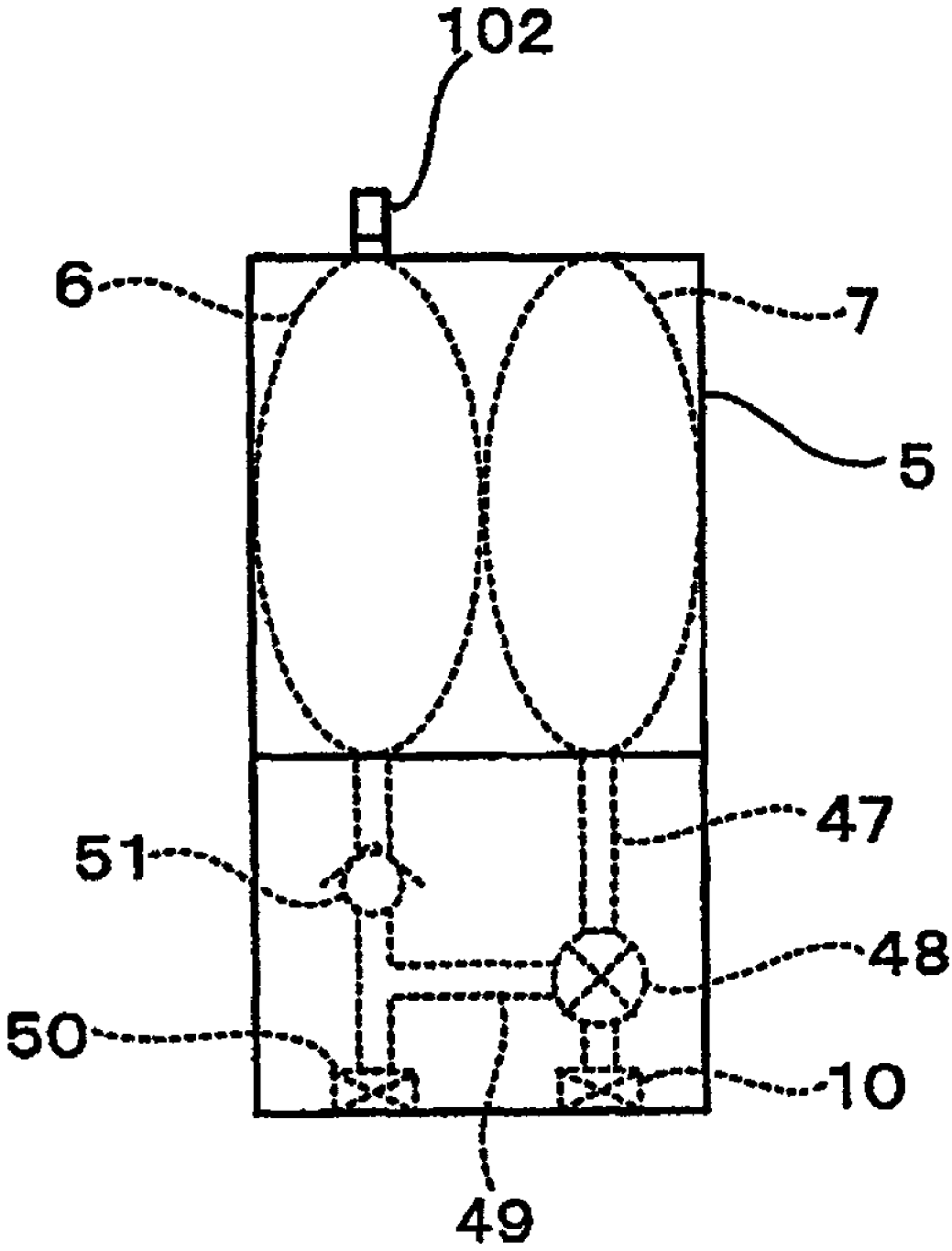
FIG. 4 is a diagram for explaining a modification of the paint cartridge.

Replenishment of water to the tank 25 follows the following steps. First, the motor 21 rotates, and the movable unit 16 moves right in the FIG. 1. Thus, the connection port 26 with the check valve at the right end of the main pipe 23 is connected to the nozzle 32. This movement of the movable unit 16 is sufficient to be relative to the nozzle 32. Instead, therefore, the tank 25 may be held stationary as shown in FIG. 4 provided the nozzle 32 is moved in the right-and-left direction by the cylinder 60.

Water in the water source 34 is supplied to the main pipe 23 by a pump 55 under a pressure. Beforehand, the first valve 29 in the movable unit 16 is opened, and the valve 30 in the first pipe 28 is closed. As a result, the water supplied from the water source 34 to the main pipe 23 flows into the tank 25 through first pipe 27. After replenishment of water to the tank 25, the motor 21 is rotated, and the movable unit 16 moves left away from the nozzle 32. The first valve 29 of the movable unit 16 is closed, and the second valve 30 is opened. Thus, preparation of water for the next electrostatic painting is completed.

When the paint cartridge 4 needs replenishment of paint after a course of painting operation of a vehicle, the painting robot is preferably moved to the paint refill station ST. In this case, the paint cartridge 4 as boarded on the electrostatic paint applicator 2 can be refilled with paint. To make it possible to refill the paint cartridge 4 with paint without the need of removing the cartridge 4 from the applicator 2, the paint cartridge 4 preferably has a pint refill port 102 in communication with the paint bag 6 at the top end of its case 5 (FIGS. 1 and 4).

FIG. 2 is a diagram for explaining an outline of the paint refill station ST. Referring to FIG. 2 in combination with FIG. 3, the paint refill station ST is located in an extent for the robotic arm 2 of the painting robot to reach. The paint refill station ST includes a board 100 fixed to a vertical wall surface or a horizontal wall surface, and support seats 101 respectively for color A, color B, color C, et seq. are supported on the board 100 to receive the paint cartridge 4.

Each support seat 101 in the paint refill station ST has a receptacle 103 for receiving the paint refill port 102 of the paint cartridge 4. A paint supply pipe 106 in communication with a paint source 105 of a particular color is connected to the receptacle 103. Quantity of paint to be supplied to the paint supply pipe 106 for each particular color A, color B, color C, or another is controlled by operating a valve unit (or set of valves) 107.

Figure 3:
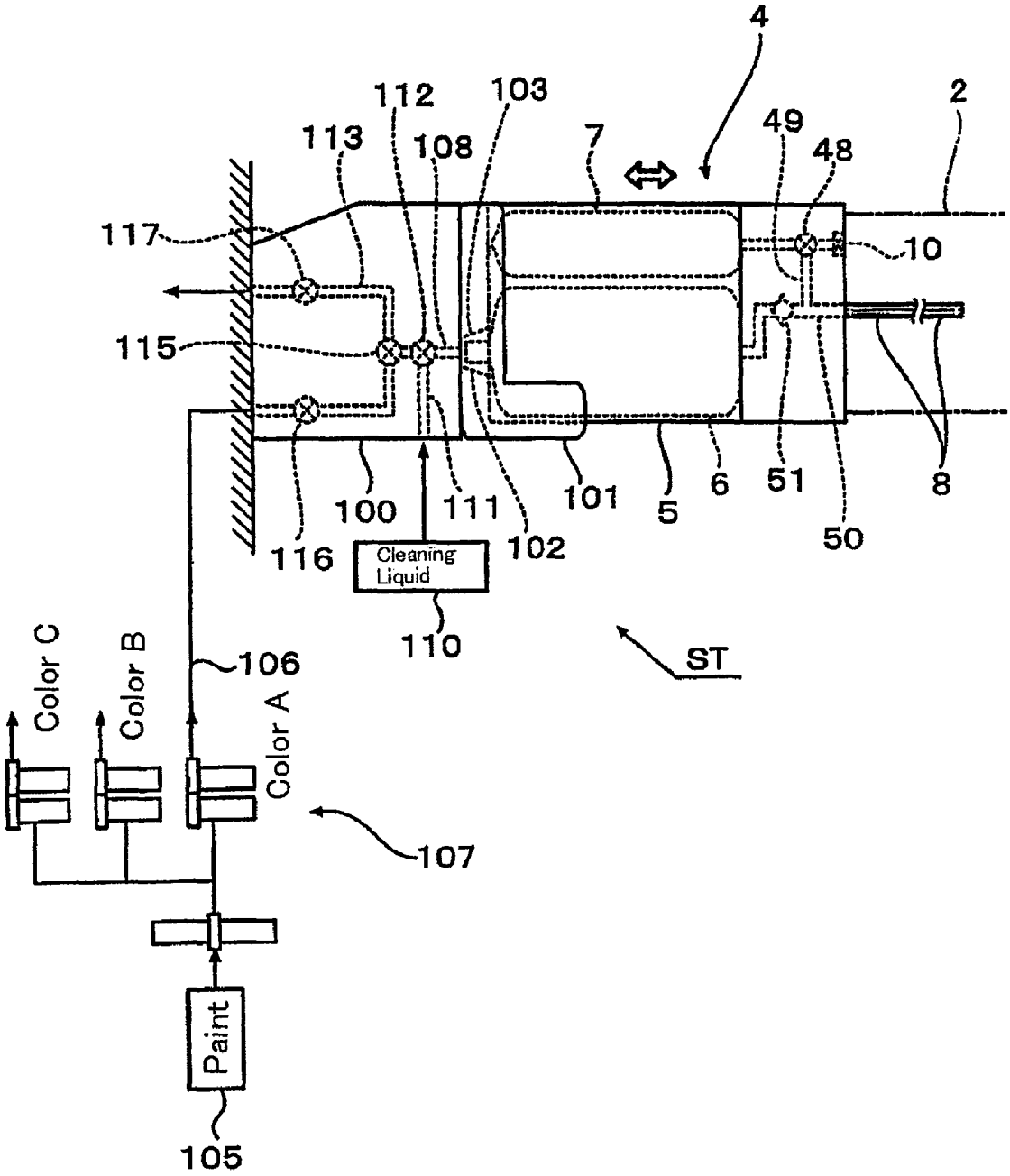
FIG. 3 is a diagram for explaining a configuration of the paint refill station.

From a main pipe 108 in communication with the receptacle 103 of the support seat 101, a cleaning liquid supply pipe 111 branches via a switching valve 112 and communicates with the cleaning liquid source 110. The receptacle 102 and the main pipe 108 are washed by the cleaning liquid supplied through the cleaning liquid supply pipe 111 in communication with the cleaning liquid source 110. Waste liquid after the cleansing is discharged externally through a waste pipe 113. In FIG. 3, reference numeral 115 denotes a flow line switching valve, 116 denotes a valve for opening and closing the paint supply pipe 106, and 117 denotes a valve for opening and closing the waste pipe 113.

When the paint cartridge 4 attached to the electrostatic paint applicator 1 of the coating robot R should be refilled with paint, or its paint should be changed for changing the color from color A to color B, the coating robot R is moved to the paint refill station ST. In case of simply refilling the cartridge 4, the robotic arm 1 is activated, and bring the paint cartridge into position on the support seat 101 for the paint of the same color A as that of the paint cartridge 4 currently on board (the state shown in FIG. 3). As a result, the paint cartridge 4 as attached to the applicator 2 is held in position on the support seat 101, and the paint refill port 102 of the paint cartridge 4 for the color A is connected to the receptacle 103 for the color A. Then, after a predetermined amount of paint of the color A is supplied into the paint bag 6 in the paint cartridge 4 via the paint refill port 102, the robotic arm 1 is activated and moves the paint cartridge 4 away from the support seat 101. After that, the coating robot R moves to its position along the electrostatic coating line L and waits ready for the next coating operation.

When the paint should be changed from color A to color B, the coating robot R moves to the paint refill station ST. Then, the robotic arm 1 is activated to first bring the currently boarded paint cartridge 4 for the color A into position on the support seat 101 for the same color A and put it into locking engagement with the support seat 101. After that, the paint cartridge 4 for the color A is unlocked from the electrostatic paint applicator 1, and the robotic arm 1 moves the applicator 1 away from the paint cartridge 4 for the color A that is left on the support seat 101 for color A. The robotic arm 1 is further operated to bring the applicator 2, now having no paint cartridge, onto the support seat 101 for color B, on which a paint cartridge 4 already refilled with paint of color B is prepared beforehand. Once the applicator 2 couples the paint cartridge 4 for color B by a movement of the robotic arm 1, the paint cartridge 4 for color B is unlocked from the support seat 101 for color B. After that, the coating robot R, now having the paint cartridge 4 for color B attached to the applicator 2, returns to its position in the coating line L.

As explained above, in case the next intended color of paint is the same as that of the former paint, the paint cartridge 4 as attached to the applicator 2, which is mounted on the coating robot, can be refilled with the paint of that color. Therefore, this coating robot does not require any additional system dedicated to transportation of paint cartridges 4 between the electrostatic paint applicator 2 and the paint refill station ST.

Also when the next intended color (color B) of paint is different from the former color (color A), i.e., when the paint color should be changed, it is possible to remove the former paint cartridge 4 of color A from the electrostatic paint applicator 2 and to board the next paint cartridge 4 of color B on the applicator 2 along with movements of the coating robot R. Therefore, here again, no additional system is required to transport paint cartridges 4 between the paint refill station ST and the coating robot R in addition to this cartridge-type coating robot R boarding the cartridge 4.

Note that FIG. 3 shows an exemplary configuration of the paint refill station ST. For example, the paint refill station ST may have a plurality of support seats 101 for each color (typically two support seats). With a plurality of support seats 101 for each color, if the former color (A) is the same as the next intended color (A), the robotic arm 1 may move to first one of the support seats 101 to put in position on this support seat 101. There, the paint cartridge is locked to the support seat 101 and unlocked from the applicator 2. Next, the robotic arm 1 may move to remove the paint cartridge 4 away from the applicator 2 and subsequently transport the applicator 2, now having no paint cartridge 4, to second one of the support seats 101 of the same color, on which another paint cartridge 4 already refilled with the same color A is set beforehand. Then, the robotic arm 1 may bring the applicator 2 without a paint cartridge into coupling engagement with said another cartridge 4 set on the second support seat 101. At the same time, the said another paint cartridge 4 is unlocked from the second support seat 101. In this manner, exchange of the paint cartridge 4 from an exhausted one to a refilled one can be accomplished by a series of movements of the robotic arm 1. Therefore, the use of a plurality of supports seats 101 for each color contributes to reducing the pause time of the coating robot R especially during the operation for refilling paint of the same color.

Figure 5:
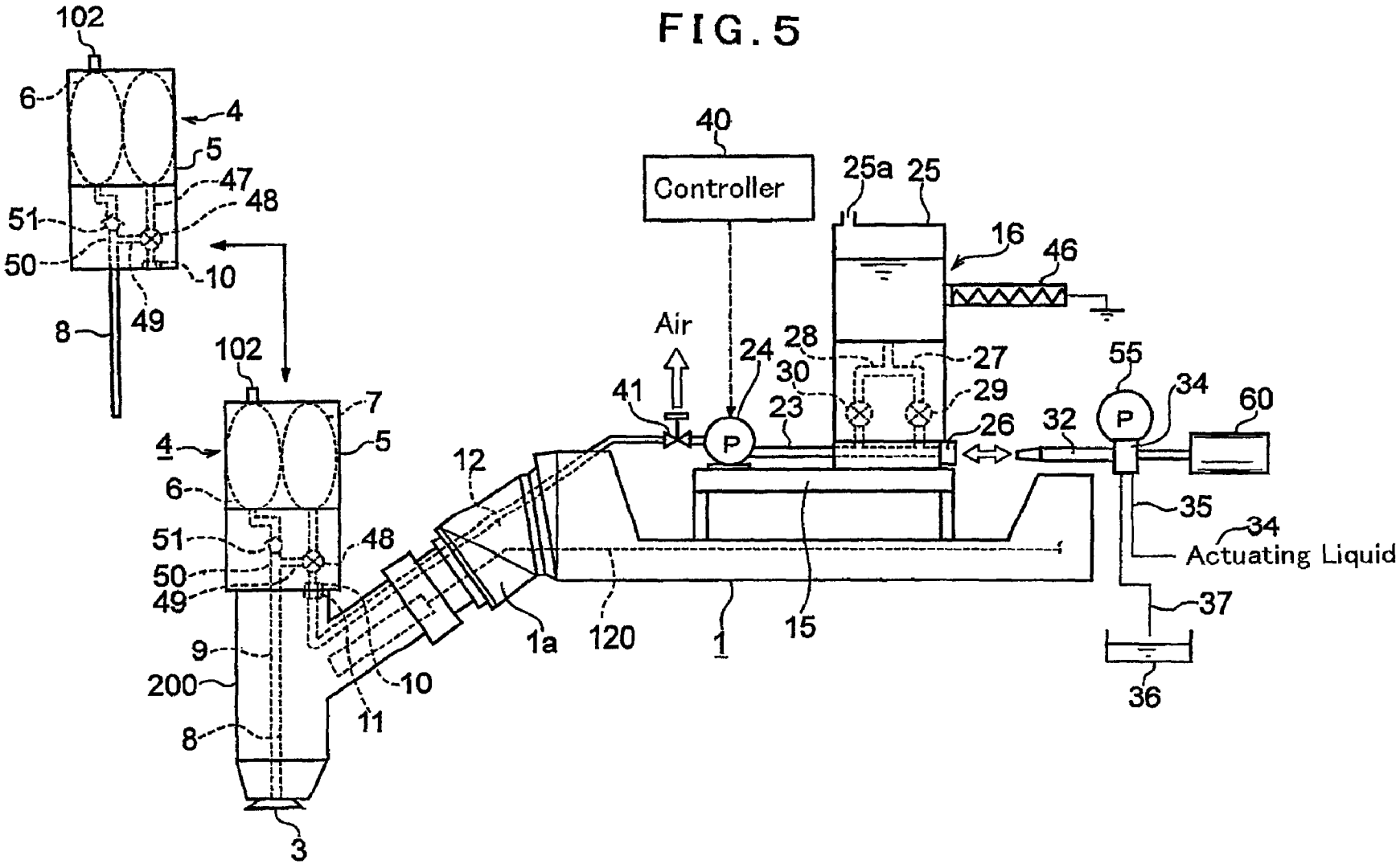
FIG. 5 is a diagram for explaining an outline of a robotic arm of a coating robot and an electrostatic paint applicator attached to the robotic arm according to the second embodiment of the present invention.

Second Embodiment (FIG. 5)

FIG. 5 shows a coating robot according to a second embodiment of the invention. This embodiment is a modification of the above-explained first embodiment as well. Shown in FIG. 4 is an electrostatic paint applicator 200 having a high voltage generator 45 inside. Instead, however, the high voltage generator 45 may be provided in the robotic arm 1 as known in the art. A high voltage is supplied from the high voltage generator 45 to the bell cup 3 by a metallic conductor (not shown) like in existing systems. The high voltage generator 45 is supplied with power via a low voltage cable 120 provided in the robotic arm 1.

In the second embodiment as well, the tank 25 contains water as an actuating liquid. However, the second embodiment may be modified to use an electrically insulating liquid (typically an insulating thinner) as the actuating liquid, and the tank 25 may contain the insulating thinner.

The tank 25 is fixed on the robotic arm 1 via an insulating table 15. A nozzle 32 positioned in confrontation with the connection port 26 with a check valve at one end of the main pipe 23 is movable between a first position and a second position with the aid of a cylinder 60 like in the first embodiment. In the first position, the tip of the nozzle 32 is apart from the connection port 26 (main pipe 23) as shown in FIG. 4. In the second position, the nozzle is inserted into the connection port 26.

According to the second embodiment, the high voltage is applied to the bell cup 3 by a metallic conductor (not shown) extending from the high voltage generator 4 located inside the electrostatic paint applicator 200 or inside the robotic arm 1. Therefore, the water or insulating thinner supplied from the tank 25 under a pressure by the pump 24 has a first role as an actuating liquid for dispensing the paint from the paint cartridge 4 to the bell cup 3 and a second role as a cleaning liquid for washing the electrostatic paint applicator 200. In addition, when water is used as the actuating liquid, the water has a third role of discharging any residual electric charge in the electrostatic paint applicator 200 to the ground potential via the bleeder resistor 46 provided on the tank 25 like in the first embodiment (FIG. 1) already explained. In the second embodiment, however, water does not act as an electric path for supplying the applicator 200 with the high voltage.

Figure 6:
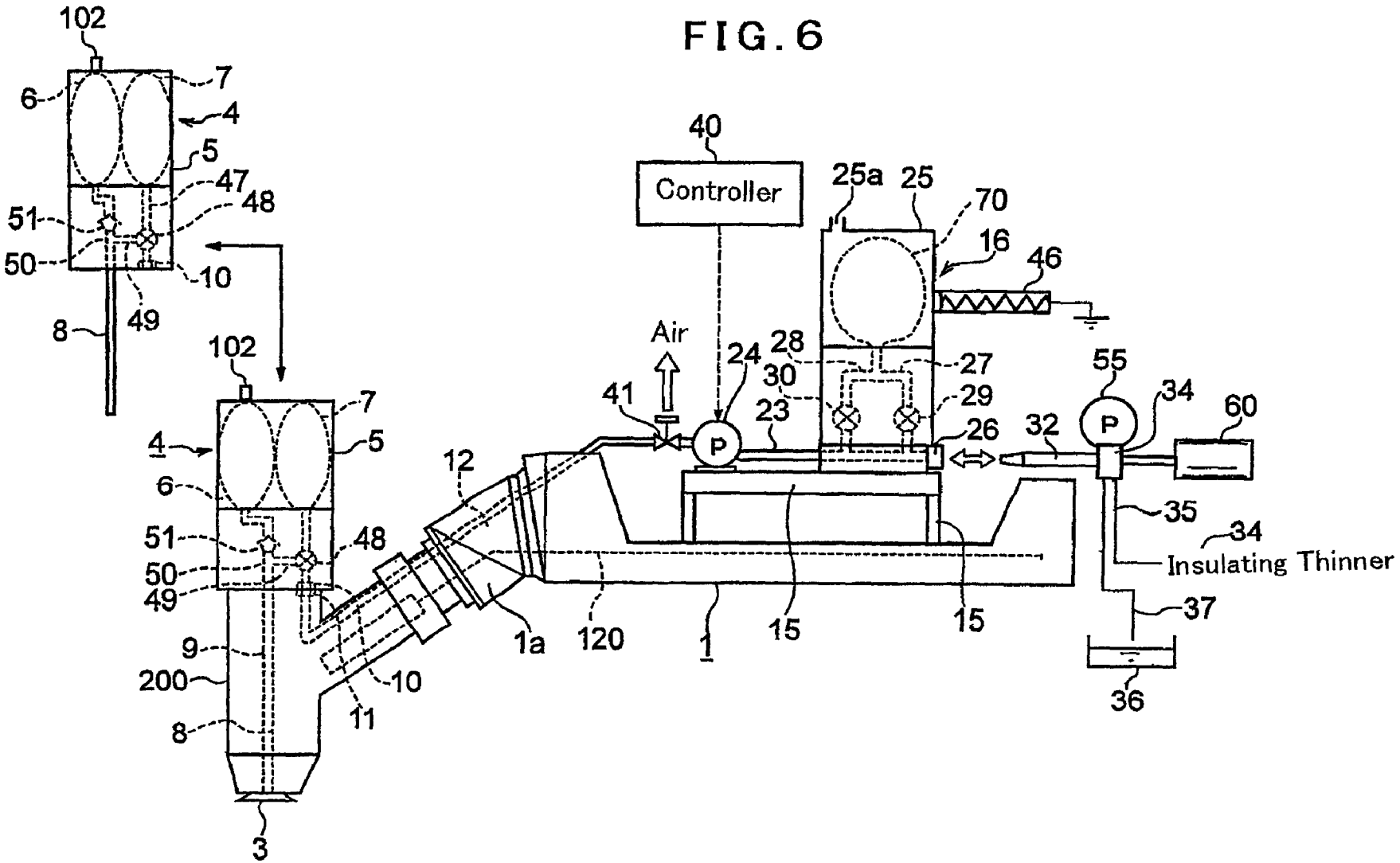
FIG. 6 is a diagram for explaining a robotic arm of a coating robot and an electrostatic paint applicator attached to the robotic arm according to the third embodiment of the present invention.

Third Embodiment (FIG. 6)

FIG. 6 shows a coating robot according to a third embodiment of the invention, which is a modification of the second embodiment as well. In the coating robot according to the third embodiment, the tank 25 contains an insulating thinner as an actuating liquid. The insulating thinner in the tank 25 has a first role as the actuating liquid for dispensing the paint in the paint cartridge 4 to the bell cup when supplied to the paint cartridge 4 (actuating bag 7) under pressure by the pump 24. In addition, the insulating thinner in the tank 25 has a second role as a cleaning liquid for washing the electrostatic paint applicator 200.

In a preferred configuration, a bag 70 is provided in the tank 25 to contain the insulating thinner. In the case where the insulating thinner as the actuating liquid is contained in the bag 70 in the tank 25, the insulating thinner as the actuating liquid is prevented from flowing out of the tank 25 even upon movements of the robotic arm. Also in the first and second embodiments, the tank 25 may include the bag 70 inside to contain the actuating liquid in the bag 70.

In the case where an electrically insulating liquid (typically, insulating thinner) as the actuating liquid, the first and second pipes 27, 30 need not be made of an insulating material. Instead, they may be made of stainless steel. The use of an insulating actuating liquid contributes to simplifying the structure related to the actuating liquid and the peripheral structure from the viewpoint of electrical insulation.

Also for the actuating liquid supply tube 12, table 15 and main pipe 23, these elements need not be made of insulating materials. The table 15, however, is preferably made of an insulating material. An insulating table 15 will prevent external leakage of the high voltage via contamination by the insulating thinner when the thinner comes to leak from the tank for a certain cause. This is applicable also to the second embodiment when it employs an insulating thinner as the actuating liquid.

In the above-described structures, the electrostatic paint applicator 2 and the various valves in the robotic arm 1 may be controlled electrically by signals output from the controller 40, or may be controlled by air.

What is claimed is:

1. A coating robot including an electrostatic paint applicator attached to a robotic arm thereof and configured to supply the electrostatic paint applicator with paint from a paint bag accommodated in a paint cartridge detachably attached to a rear end of the electrostatic paint applicator by squeezing the paint bag in the paint cartridge with a controlled amount of actuating liquid supplied into the paint cartridge, comprising:

a tank fixed on the robotic arm and containing the actuating liquid;

an actuating liquid supply path for supplying the actuating liquid from the tank to the paint cartridge; and a pump interposed in the actuating liquid supply path to supply the actuating liquid from the tank to the paint cartridge under pressure.

2. The coating robot according to claim 1 wherein said pump is located inside the robotic arm.

3. The coating robot according to claim 2 wherein said tank includes a bag inside to contain the actuating liquid in the bag.

4. The coating robot according to claim 3 further comprising a connection means provided in an actuating liquid refill station and configured for relative moment to and away from the actuating liquid supply path, wherein, when the connection means approaches and gets into connection with the actuating liquid supply path, the bag in the tank is refilled with the actuating liquid supplied from an actuating liquid source through the actuating liquid supply path.

5. The coating robot according to claim 4 wherein said connection means provided in the actuating liquid refill station is set stationary in said station, wherein a part of the actuating liquid supply path in the robotic arm is movable in the lengthwise direction of the robotic arm, and wherein, when the part of the actuating liquid supply path is moved by a drive means, the actuating liquid supply path is connected to or disconnected from the connection means in the actuating liquid refill station.

6. The coating robot according to claim 5 further comprising an actuating-purpose passageway for supplying the actuating liquid from the tank to the paint cartridge and a cleaning-purpose passageway for cleaning the electrostatic paint applicator with the actuating liquid from the tank both provided in a lower end portion of the paint cartridge such that the actuating-purpose passageway and the cleaning-purpose passageway are selectively set in communication with the tank.

7. The coating robot according to claim 6 further comprising a paint feed tube provided at a lower end of the paint cartridge and communicating with the paint bag via a check valve, wherein said electrostatic paint applicator has a pore opening at a rear end thereof to receive said paint feed tube therein.

8. The coating robot according to claim 1 wherein said tank is fixed stationary on the robotic arm under an electrically insulated condition.

9. The coating robot according to claim 1 wherein the actuating liquid is an electrically insulating liquid.

10. The coating robot according to claim 1 wherein the actuating liquid is water.

11. The coating robot according to claim 10 wherein the high voltage is applied to the electrostatic paint applicator via the water as the actuating liquid.

* * * * *